US011695207B2

(12) United States Patent
Kashino et al.

(10) Patent No.: US 11,695,207 B2
(45) Date of Patent: Jul. 4, 2023

(54) VEHICLE ANTENNA DEVICE WITH SIDE WALL LENS

(71) Applicant: Panasonic Intellectual Property Management Co., Ltd., Osaka (JP)

(72) Inventors: Yuichi Kashino, Ishikawa (JP); Hiroyuki Uno, Ishikawa (JP); Tomoaki Nishikido, Ishikawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 17/045,849

(22) PCT Filed: Apr. 8, 2019

(86) PCT No.: PCT/JP2019/015313
§ 371 (c)(1),
(2) Date: Oct. 7, 2020

(87) PCT Pub. No.: WO2019/198662
PCT Pub. Date: Oct. 17, 2019

(65) Prior Publication Data

US 2021/0075105 A1 Mar. 11, 2021

(30) Foreign Application Priority Data

Apr. 12, 2018 (JP) ..... JP2018-076907

(51) Int. Cl.
*H01Q 3/36* (2006.01)
*H01Q 3/26* (2006.01)
(Continued)

(52) U.S. Cl.
CPC ..... *H01Q 3/36* (2013.01); *H01Q 1/3225* (2013.01); *H01Q 3/2658* (2013.01); *H01Q 3/30* (2013.01);
(Continued)

(58) Field of Classification Search
CPC ..... H01Q 3/36; H01Q 3/2658; H01Q 15/23; H01Q 19/06; H01Q 1/3225; H01Q 19/17; H01Q 3/30; H01Q 15/08; H01Q 15/02
See application file for complete search history.

(56) References Cited

U.S. PATENT DOCUMENTS 4,987,418 A * 1/1991 Kosowsky ..... H01Q 15/148 342/6
6,999,044 B2 * 2/2006 Durham ..... H01Q 3/2658 343/756
(Continued)

FOREIGN PATENT DOCUMENTS

JP H08186421 A 7/1996
JP 2010245921 A 10/2010
(Continued)

OTHER PUBLICATIONS

International Search Report, dated May 7, 2019, for corresponding International Application No. PCT/JP2019/015313, 3 pages.

*Primary Examiner* — Andrea Lindgren Baltzell
*Assistant Examiner* — Yonchan J Kim
(74) *Attorney, Agent, or Firm* — Seed IP Law Group LLP

(57) ABSTRACT

Provided is an antenna device with a simple configuration and in which it is possible to control the directivity in various directions. An antenna device according to the present invention is provided with: an array antenna that includes at least one antenna element disposed on a first surface of a substrate and that forms beams in respective directions having a plurality of angles including a first angle relative to the first surface of the substrate; and a side wall that is provided on at least a partial periphery of the at least one antenna element and that refracts, in a direction along the substrate, a first beam in the direction having the first angle.

15 Claims, 12 Drawing Sheets

(51) Int. Cl.

| | |
|---|---|
| ***H01Q 15/23*** | (2006.01) |
| ***H01Q 19/06*** | (2006.01) |
| ***H01Q 19/17*** | (2006.01) |
| ***H01Q 3/30*** | (2006.01) |
| ***H01Q 1/32*** | (2006.01) |

(52) U.S. Cl.
CPC ..... *H01Q 15/23* (2013.01); *H01Q 19/06* (2013.01); *H01Q 19/17* (2013.01)

(56) References Cited

U.S. PATENT DOCUMENTS

| | | | | |
|---|---|---|---|---|
| 10,012,720 | B2 * | 7/2018 | Emanuelsson | G01S 13/931 |
| 2012/0249388 | A1 * | 10/2012 | Hansen | H01Q 1/2266 343/753 |
| 2015/0311589 | A1 | 10/2015 | Yokoyama et al. | |
| 2019/0067827 | A1 * | 2/2019 | Sakai | G01S 7/03 |
| 2019/0165462 | A1 * | 5/2019 | Shiozaki | H01Q 1/42 |
| 2019/0165483 | A1 * | 5/2019 | Shiozaki | H01Q 1/42 |
| 2019/0271762 | A1 * | 9/2019 | Sakai | G01S 13/93 |

FOREIGN PATENT DOCUMENTS

| | | | |
|---|---|---|---|
| JP | 2011055419 | A | 3/2011 |
| JP | 2014/097846 | A1 | 6/2014 |
| JP | 2016-072806 | A | 5/2016 |
| JP | 2017-150894 | A | 8/2017 |
| JP | 2018-017552 | A | 2/2018 |

* cited by examiner

| | #1 [deg.] | #2 [deg.] | #3 [deg.] | #4 [deg.] |
|---|---|---|---|---|
| Case1 | 0 | 0 | 0 | 0 |
| Case2 | 0 | 60 | 120 | 180 |
| Case3 | 0 | 150 | 300 | 450 |
| Case4 | 0 | -150 | -300 | -450 |

FIG. 6

VEHICLE ANTENNA DEVICE WITH SIDE WALL LENS

TECHNICAL FIELD

The present disclosure relates to an antenna apparatus.

BACKGROUND ART

In recent years, an antenna in which it is possible to control the directivity by forming a plurality of beams having different radiation directions has been studied in order to realize a wide communication area or a wide detection area for radio communication apparatuses or radar apparatuses. For example, for radio communication apparatuses, an antenna apparatus capable of handling a plurality of situations in which directions where communication partners are present are different has been in demand.

For example, Patent Literature (hereinafter, referred to as "PTL") 1 discloses an antenna apparatus which includes a plurality of substrates each including one or more antenna elements, and in which it is possible to control the directivity in the horizontal and vertical directions of the apparatus by assembling the plurality of substrates three-dimensionally.

CITATION LIST

Patent Literature

PTL 1
WO 2014-097846

SUMMARY OF INVENTION

Technical Problem

However, the antenna apparatus disclosed in PTL 1 has a complicated structure due to the three-dimensional assemblage of the plurality of substrates.

One non-limiting and exemplary embodiment of the present disclosure facilitates providing an antenna apparatus which has a simple configuration and in which it is possible to control the directivity in various directions.

An antenna apparatus according to an embodiment of the present disclosure includes: an array antenna that includes at least one antenna element disposed on a first surface of a substrate and that forms beams in respective directions forming a plurality of angles including a first angle with respect to the first surface of the substrate; and a side wall that is provided in at least a part of a periphery of the at least one antenna element and that refracts a first beam in a direction along the substrate, the first beam being in a direction forming the first angle.

It should be noted that general or specific embodiments may be implemented as a system, an apparatus, an integrated circuit, a computer program or a storage medium, or may be implemented as any combination of a system, an apparatus, a method, an integrated circuit, a computer program, and a storage medium.

An embodiment of the present disclosure facilitates providing an antenna apparatus which has a simple configuration and in which it is possible to control the directivity in various directions.

Additional benefits and advantages of the disclosed embodiment will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF DRAWINGS

FIG. 6 illustrates a table of exemplary excitation phases in which an antenna element is excited;

DESCRIPTION OF EMBODIMENTS

An antenna apparatus according to an embodiment to be described below relates to, for example, an antenna apparatus applied to a radio communication apparatus mounted on a vehicle. Hereinafter, a situation in which a vehicle on which a radio communication apparatus including the antenna apparatus is mounted performs radio communication will be described.

Figure 1:
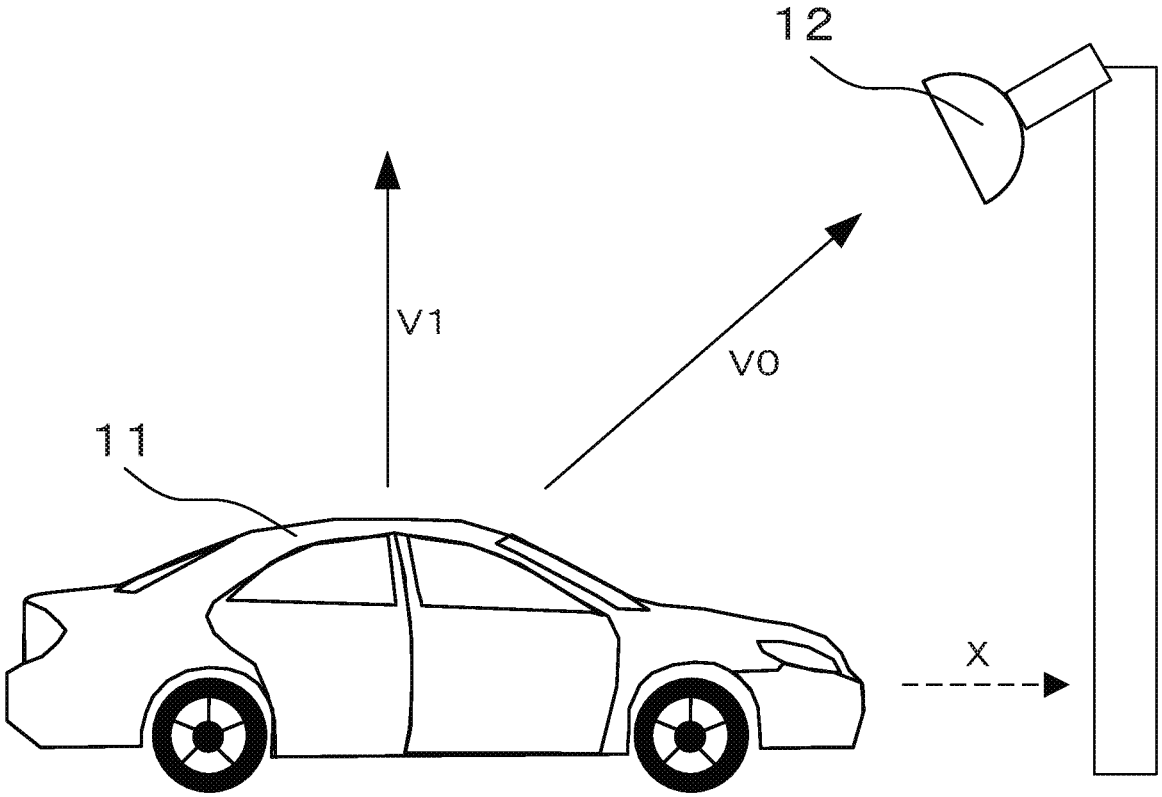
FIG. 1 illustrates a first example of a situation in which a vehicle performs radio communication.

FIG. 1 illustrates a first example of the situation in which the vehicle performs radio communication. FIG. 1 illustrates vehicle 11 on which the radio communication apparatus including the antenna apparatus is mounted, and roadside machine 12 that is provided on a side strip and that is a communication partner of the radio communication apparatus of vehicle 11.

The example of FIG. 1 is a situation of road-to-vehicle communication in which communication is performed between the vehicle and the roadside machine provided on the side strip. Since roadside machine 12 is provided above vehicle 11 in the road-to-vehicle communication, the antenna apparatus of vehicle 11, for example, controls the directivity such that the gain becomes high in obliquely upward direction V0 with respect to traveling direction X. Obliquely upward direction V0 is, for example, a direction of 30 degrees to 45 degrees with respect to traveling direction X.

Further, in a case where vehicle 11 travels in traveling direction X and passes below roadside machine 12 in the situation of FIG. 1, roadside machine 12 is located in the zenith direction of vehicle 11. Accordingly, the antenna apparatus of vehicle 11 controls the directivity such that the gain becomes high in zenith direction V1 of vehicle 11.

Figure 2:
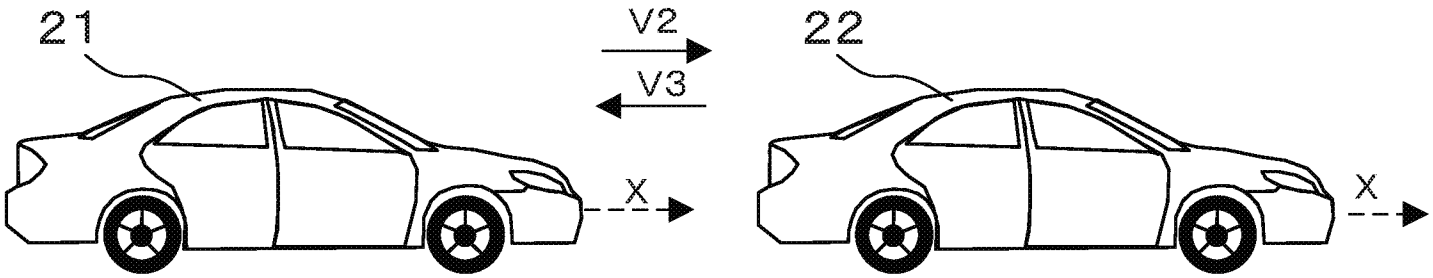
FIG. 2 illustrates a second example of the situation in which the vehicle performs radio communication.

FIG. 2 illustrates a second example of the situation in which the vehicle performs radio communication. FIG. 2 illustrates vehicle 21 and vehicle 22 on both of which the radio communication apparatus including the antenna apparatus is mounted.

The example of FIG. 2 is a situation of vehicle-to-vehicle communication in which communication is performed between vehicle 21 and vehicle 22. In the case of vehicle-to-vehicle communication, the antenna apparatuses of vehicle 21 and vehicle 22 control the directivity in a direction along the traveling direction.

For example, vehicle 22 that is the communication partner of vehicle 21 is traveling in front of vehicle 21. Accordingly, the antenna apparatus of vehicle 21 controls the directivity such that the gain becomes high in direction V2 that is the same as traveling direction X. Further, vehicle 21 that is the communication partner of vehicle 22 is traveling behind vehicle 22. Accordingly, the antenna apparatus of vehicle 22 controls the directivity such that the gain becomes high in direction V3 opposite to traveling direction X.

As described with reference to FIGS. 1 and 2, the antenna apparatus mounted on the vehicle controls the directivity in the obliquely upward direction, in the zenith direction, and in the horizontal direction with respect to the traveling direction of the vehicle. Thus, the embodiment of the present disclosure facilitates providing an antenna apparatus in which it is possible to control the directivity in various directions.

Hereinafter, embodiments of the present disclosure will be described in detail with reference to the accompanying drawings. Note that, each of the embodiments described below is merely exemplary, and the present disclosure is not limited by these embodiments.

Embodiment

Figure 3A:
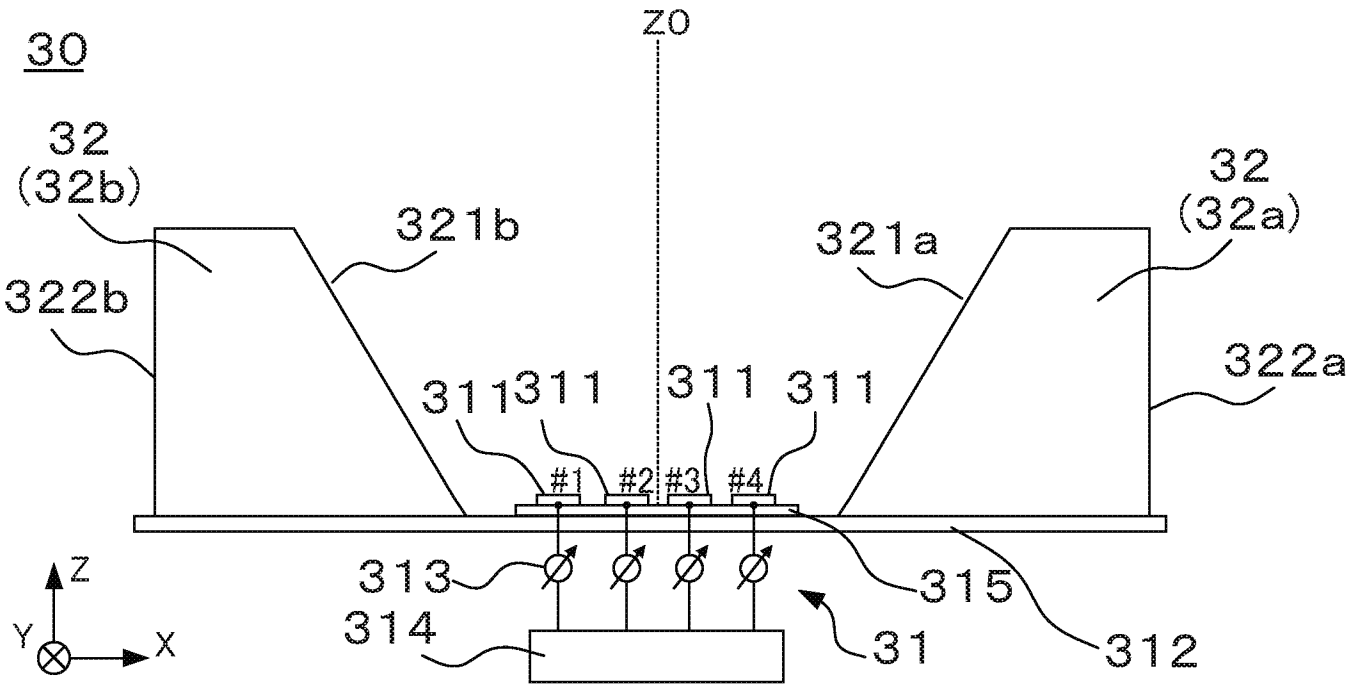
FIG. 3A is a side view of an example of an antenna apparatus according to an embodiment of the present disclosure.
Figure 3B:
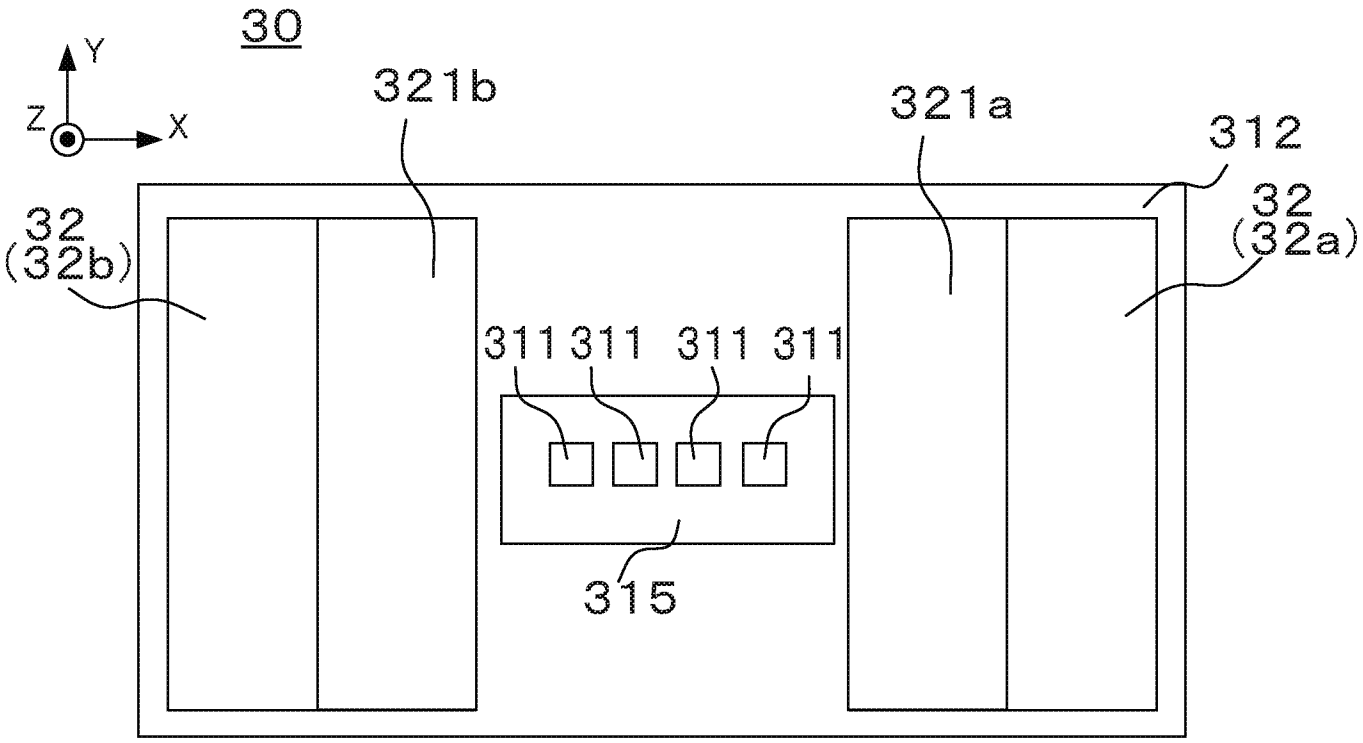
FIG. 3B is a plan view of the example of the antenna apparatus according to the embodiment of the present disclosure.

FIG. 3A is a side view of an example of antenna apparatus 30 according to the present embodiment. FIG. 3B is a plan view of the example of antenna apparatus 30 according to the present embodiment.

Note that, FIGS. 3A and 3B illustrate an X axis, a Y axis, and a Z axis. The X axis indicates an arrangement direction of antenna elements 311 to be described later, and the Y axis indicates a direction vertical to the X axis on a plane on which antenna elements 311 are arranged. Further, the Z axis indicates a direction vertical to the X axis and the Y axis. FIG. 3A is a side view of an X-Z plane of antenna apparatus 30, and FIG. 3B is a diagram of an X-Y plane of antenna apparatus 30 viewed from the positive direction of the Z axis.

Further, line Z0 illustrated in FIG. 3A is an auxiliary line extending from a center of a length in the arrangement direction of four antenna elements 311 in the positive direction of the Z axis. Line Z0 corresponds to a direction in which radio waves radiated in a case where antenna elements 311 of antenna apparatus 30 are excited in the same phase indicate the maximum gain.

Antenna apparatus 30 illustrated in FIGS. 3A and 3B includes array antenna 31 and side wall 32.

Array antenna 31 includes antenna element 311 disposed on a first surface (a surface in the positive direction of the Z axis) of insulation layer 315 of a substrate, and forms beams in respective directions forming a plurality of angles with respect to a plane of the substrate. The directions of the beams formed by array antenna 31 include at least first angle θx (see FIG. 4) that is preset. Hereinafter, a beam formed in a direction forming first angle θx may be referred to as first beam.

For example, the beam formed in the direction forming first angle θx may correspond to radiation of radio waves having the maximum gain in the direction of first angle θx.

Array antenna 31 includes, for example, four antenna elements 311, reflector 312, four phase shifters 313, and controller 314.

Four antenna elements 311 are disposed, for example, on a surface in the positive direction of the Z axis of insulation layer 315, along the direction of the X axis. Four antenna elements 311 are patch antennas formed by conductor patterns. For example, four antenna elements 311 are formed by etching copper-clad substrates composed of a dielectric.

Note that, four antenna elements 311 may be referred to as antenna elements #1 to #4 in order from the negative direction of the X axis. Further, four antenna elements 311 may be collectively referred to as antenna element 311.

Reflector 312 is, for example, a conductor provided on a surface of the negative direction of the Z axis of insulation layer 315. For example, reflector 312 reflects, among radio waves radiated by antenna element 311, radio waves, which are radiated in the negative direction of the Z axis, in the positive direction of the Z axis.

Each of four phase shifters 313 is electrically connected to one corresponding antenna element 311 of four antenna elements 311, and controls an excitation phase of antenna element 311.

Controller 314 controls the directivity of array antenna 31. For example, controller 314 is connected to each of four phase shifters 313, and sets magnitudes of excitation phases of four phase shifters 313.

Note that, the configuration of array antenna 31 described above is exemplary, and the present disclosure is not limited thereto. For example, antenna element 311 is not limited to a patch antenna, and may be a slot-shaped antenna or a loop-shaped antenna. Antenna element 311 may be a plane antenna different from the above example. Further, the number of antenna element 311 may be three or less, or may be five or more.

Further, FIG. 3A illustrates four phase shifters 313 and controller 314 in the negative direction of the Z axis with respect to antenna element 311 for convenience of illustration. For example, four phase shifters 313 and controller 314 may be included in a radio section (not illustrated) disposed on a surface of insulation layer 315, which is the same as that with antenna element 311. In this case, for example, a microstrip line may connect between the radio and antenna element 311.

Side wall 32 is provided in at least a part of a periphery of array antenna 31. For example, in the examples of FIGS. 3A and 3B, a plurality of side walls 32 are provided on, among the surfaces of insulation layer 315, for example, a surface in the positive direction of the Z axis of insulation layer 315, along the arrangement direction (the X-axis direction) of antenna element 311. In this case, for example, side wall 32 may not be provided in the Y-axis direction as illustrated in FIG. 3B.

Side wall 32 refracts the first beam in the direction forming first angle θx formed by array antenna 31, in the direction along a plane (the X-Y plane) on which antenna element 311 is provided.

For example, the material of side wall 32 is a dielectric. The material used for side wall 32 is, for example, an acrylic resin, a tetrafluoroethylene resin, a polystyrene resin, a polycarbonate resin, a polybutylene terephthalate resin, a polyphenylene resin, a polypropylene resin, a syndiotactic polystyrene resin or an ABS resin.

The interior of side wall 32 may be filled with a dielectric or a material different from a dielectric. Alternatively, the interior of side wall 32 may include a cavity.

Side wall 32 includes side wall 32*a* and side wall 32*b*. Side wall 32*a* and side wall 32*b* are provided plane symmetrically with respect to a Y-Z plane along line Z0.

Side wall 32*a* includes first side surface 321*a* and second side surface 322*a*.

First side surface 321*a* is, of the two side surfaces of side wall 32*a*, a side surface close to antenna element 311. At least the first beam is made incident on first side surface 321*a* (for example, see FIG. 4). First side surface 321*a* has a tapered shape such that first side surface 321*a* is away from line Z0 toward the positive direction in the X axis as first side surface 321*a* is away from the plane on which antenna element 311 is provided in the Z-axis direction.

Second side surface 322*a* is, of the two side surfaces of side wall 32*a*, a side surface far from antenna element 311. For example, second side surface 322*a* is vertical to the X axis. Second side surface 322*a* is a surface from which the first beam incident on first side surface 321*a* is emitted (for example, see FIG. 4). The first beam emitted from second side surface 322*a* is radiated in a direction along the X axis.

Note that, the thickness in the X direction of side wall 32*a* between first side surface 321*a* and second side surface 322*a* is not particularly limited.

Side wall 32*b* includes first side surface 321*b* and second side surface 322*b*.

First side surface 321*b* is, of the two side surfaces of side wall 32*b*, a side surface close to antenna element 311. At least the first beam is made incident on first side surface 321*b*. First side surface 321*b* has a tapered shape such that first side surface 321*b* is away from line Z0 toward the negative direction in the X axis as first side surface 321*b* is away from the plane on which antenna element 311 is provided in the Z-axis direction.

Second side surface 322*b* is, of the two side surfaces of side wall 32*b*, a side surface far from array antenna 31. For example, second side surface 322*b* is vertical to the X axis. Second side surface 322*b* is a surface from which the first beam incident on first side surface 321*b* is emitted. The first beam emitted from second side surface 322*b* is radiated in the direction along the X axis.

Note that, the thickness in the X direction of side wall 32*b* between first side surface 321*b* and second side surface 322*b* is not particularly limited.

Next, the relationship between first side surface 321*a* of side wall 32*a* and a beam direction of array antenna 31 will be described with reference to FIG. 4.

Figure 4:
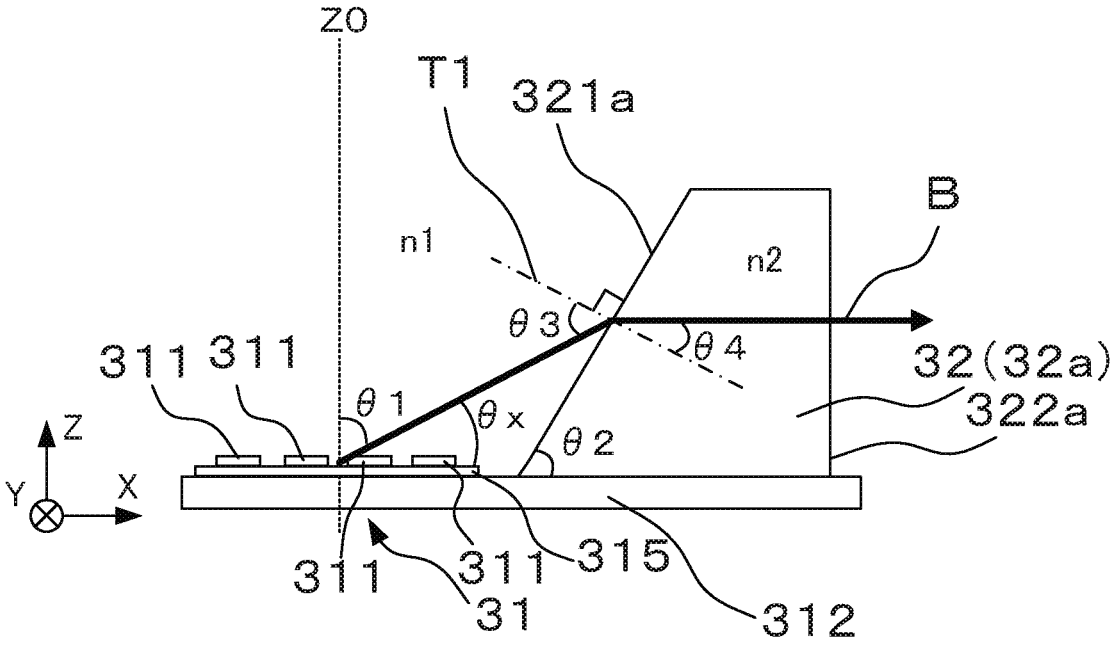
FIG. 4 illustrates a first example of a shape of a side wall.

FIG. 4 illustrates a first example of a shape of side wall 32*a*. Note that, in FIG. 4, the same configurations as those of FIGS. 3A and 3B are denoted by the same reference signs, and descriptions thereof are omitted. Further, in FIG. 4, some configurations illustrated in FIGS. 3A and 3B are omitted for convenience of illustration.

FIG. 4 is a side view of the X-Z plane of antenna apparatus 30 as with FIG. 3A. The example of FIG. 4 is an example in which array antenna 31 radiates radio waves in a space having refractive index n1. In this example, the radio waves radiated by array antenna 31 are made incident on first side surface 321*a* of side wall 32*a* filled with a dielectric having refractive index n2. Then, the radio waves refracted at an interface of first side surface 321*a* are emitted from second side surface 322*a*.

Arrow B indicates an example of a trajectory of traveling radio waves in a case where array antenna 31 radiates the radio waves having the maximum gain in a direction of tilt angle θ1. Note that, the radio waves having the maximum gain in the direction of tilt angle θ1 form an angle of θx=(90°−θ1) on the X-Z plane illustrated in FIG. 4 in a case where the X-Y plane is 0°. Note that, the X-Y plane serving as a reference of 0° is, for example, the first surface of the substrate (the surface of insulation layer 315 on which four antenna elements 311 are provided). Further, in the X-Z plane illustrated in FIG. 4, the reference of 0° may correspond to the X axis.

Note that, hereinafter, line Z0 is set as a reference of an angle of 0 degrees, and an angle in the clockwise direction from line Z0 in FIG. 4 is set as a positive angle for convenience of description.

Line T1 illustrated in FIG. 4 is an auxiliary line vertical to first side surface 321*a* on the X-Z plane.

θ2 is an angle of inclination of first side surface 321*a* in a case where the X-Y plane is 0°. θ3 is an angle of incidence of the radio waves indicated by arrow B to first side surface 321*a*, and θ4 is an angle of refraction. Note that, hereinafter, the angle of inclination of the side surface may be an angle formed by the side surface with respect to the X-Y plane, with the X-Y plane as a reference of 0°, on the X-Z plane.

Antenna apparatus 30 realizes the directivity along the direction of the X axis by utilizing a refraction generated in a case where the radio waves are made incident on a dielectric layer of refractive index n2 from an air layer of refractive index n1.

For example, when using Snell's law, a relationship among refractive index n1, refractive index n2, angle of incidence θ3 and refractive angle θ4 is given by following equation 1.

[1]

$$n1\times\sin\theta3=n2\times\sin\theta4 \quad \text{(Equation 1)}$$

Further, a relationship among refractive index n1, refractive index n2, tilt angle θ1, and tilt angle θ2 of first side surface 321*a*, which satisfies a condition that the refracted radio waves travel along the direction of the X axis, is derived based on equation 1. For example, the relationship among refractive index n1, refractive index n2, tilt angle θ1, and tilt angle θ2 of first side surface 321*a* is given by equation 2.

[2]

$$\tan\theta2 = \cot\theta1 + \frac{n2}{n1}\csc\theta1 \quad \text{(Equation 2)}$$

In a case where the relationship of equation 2 is satisfied, the radio waves refracted on first side surface 321*a* travel inside side wall 32*a* along the direction of the X axis, and are emitted from second side surface 322*a*. In a case where second side surface 322*a* is vertical to the direction of the X axis, the radio waves are transmitted through second side surface 322*a* with no change in the direction of the radio waves.

Note that, refractive index n1 and refractive index n2 are determined by a parameter (for example, a relative permittivity) of the material. For example, in a case where side wall 32*a* is filled with a dielectric having a relative permittivity ranging from 2 to 6 and refractive index n1 is the refractive index of air, tilt angle θ2 is preferably 65 degrees or less.

For example, in a case where side wall 32*a* is filled with a dielectric having a relative permittivity ranging from 2 to 5, the radio waves that are not refracted, but reflected on first side surface 321*a* can be reduced so that the radio waves radiated from array antenna 31 are efficiently radiated from second side surface 322*a*.

As described above, in antenna apparatus 30 according to the present embodiment, in a case where array antenna 31 radiates the radio waves having the maximum gain in the direction of tilt angle θ1, the radiated radio waves are refracted on first side surface 321*a* of side wall 32, the direction thereof is changed in the direction of the X axis, and the radio waves are emitted from second side surface 322*a*. Further, angle of inclination θ2 of first side surface 321*a* is defined by the relationship among refractive index n1, refractive index n2, and tilt angle θ1 so as to satisfy the condition that the refracted radio waves travel along the direction of the X axis.

Note that, for example, the relationship among refractive index n1, refractive index n2, tilt angle θ1 and angle of inclination θ2 may have a minute deviation with respect to the relationship given in equation 2. For example, in a case where there is a minute deviation in tilt angle θ1 and/or angle of inclination θ2 in equation 2, the direction indicating the maximum gain of the radio waves radiated from antenna apparatus 30 includes the minute deviation with respect to the direction along the X axis. However, since the radio waves radiated by array antenna 31 have a beam width, it is possible to realize good communication characteristic even when a minute deviation is included with respect to the direction along the X axis.

In other words, in a case where side wall 32*a* is provided based on the relationship between tilt angle θ1 and angle of inclination θ2 defined by equation 2, array antenna 31 may radiate radio waves having the maximum gain in a direction within a predetermined angular range with respect to tilt angle θ1, for example. In this case, the radio waves having the maximum gain in the direction within the predetermined angular range with respect to tilt angle θ1 are refracted on first side surface 321*a*, and are radiated from second side surface 322*a* in the direction along the X axis.

Further, although the above description has indicated an example in which second side surface 322*a* is vertical to the direction of the X axis, the present disclosure is not limited thereto. For example, in a case where second side surface 322*a* has a minute deviation from the surface vertical to the direction of the X axis, the direction having the maximum gain of the radio waves radiated from antenna apparatus 30 includes the minute deviation with respect to the direction along the X axis. However, since the radio waves radiated by array antenna 31 have a beam width, it is possible to realize good communication characteristic even when a minute deviation is included with respect to the direction along the X axis.

Further, the above description has indicated an example in which the radio waves are refracted on first side surface 321*a*, the traveling direction of the radio waves is changed in the direction along the X axis, and the radio waves are transmitted through second side surface 322*a* with no change in the traveling direction of the radio waves. The present disclosure is not limited thereto. For example, the radio waves may be refracted on both first side surface 321*a* and second side surface 322*a* such that the radio waves emitted from second side surface 322*a* are along the direction of the X axis. In this case, the angle of inclination of first side surface 321*a* and the angle of inclination of second side surface 322*a* may be defined based on, for example, refractive index n1 of the air layer, the dielectric layer n2, and tilt angle θ1.

Note that, side wall 32*a* has been described as an example in the above description. However, in a case where side wall 32*a* and side wall 32*b* are provided plane symmetrically with respect to the Y-Z plane along line Z0, first side surface 321*b* and second side surface 322*b* may be defined based on the plane-symmetrical relationship, respectively, as with first side surface 321*a* and second side surface 322*a*.

For example, in a case where first side surface 321*b* and second side surface 322*b* are defined based on the plane-symmetrical relationship, the radio waves which are radiated by array antenna 31 and in which the tilt angle has the maximum gain in the direction of −θ1 are refracted on first side surface 321*b*, the direction thereof is changed in the negative direction of the X axis, and are emitted from second side surface 322*b*. In this case, the angle of inclination of first side surface 321*b* is θ2.

Note that, although an example in which side wall 32*a* and side wall 32*b* are provided plane symmetrically has been indicated, the present disclosure is not limited thereto. For example, side walls 32*a* and 32*b* may be configured with dielectrics different from each other. Further, for example, the angle of inclination of first side surface 321*a* of side wall 32*a* and the angle of inclination of first side surface 321*b* of side wall 32*b* may not be the same. Further, for example, side wall 32*a* may be configured to include first side surface 321*a* and second side surface 322*a* illustrated in FIG. 4, and side wall 32*b* may be configured to refract radio waves on both first side surface 321*b* and second side surface 322*b* as in the above-described example.

Further, for example, antenna apparatus 30 may be provided with either one of side wall 32*a* and side wall 32*b*. For example, in a case where antenna apparatus 30 does not radiate radio waves in the negative direction of the X axis, antenna apparatus 30 may not include side wall 32*b*.

Next, the position of side wall 32*a* will be described.

Figure 5A:
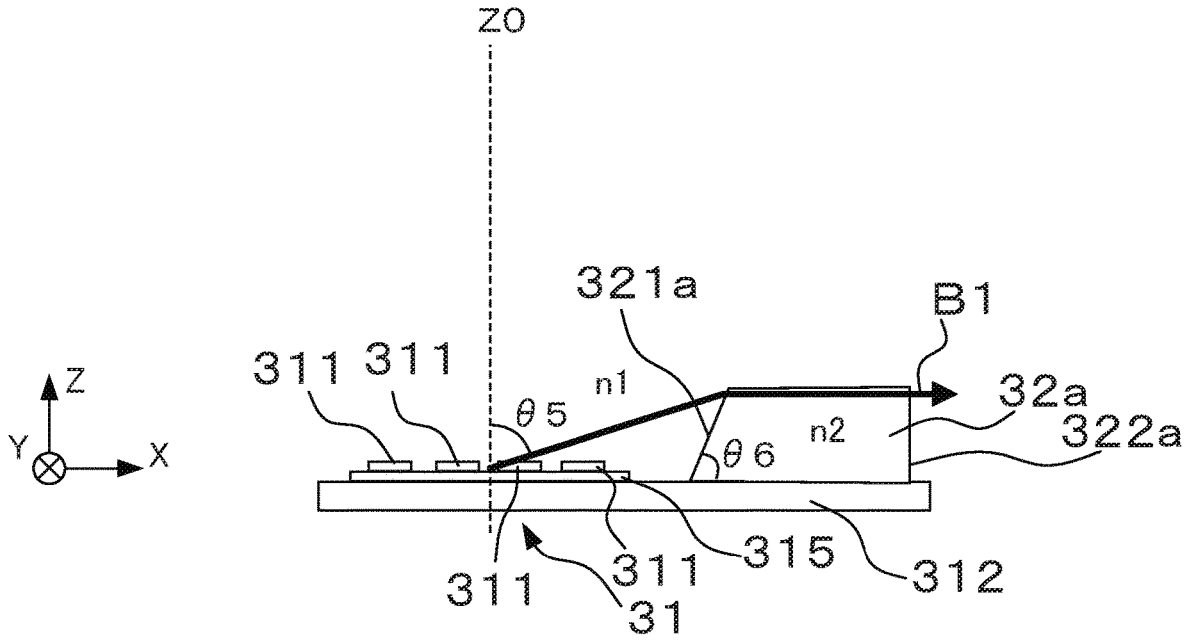
FIG. 5A illustrates a second example of the shape of the side wall.
Figure 5B:
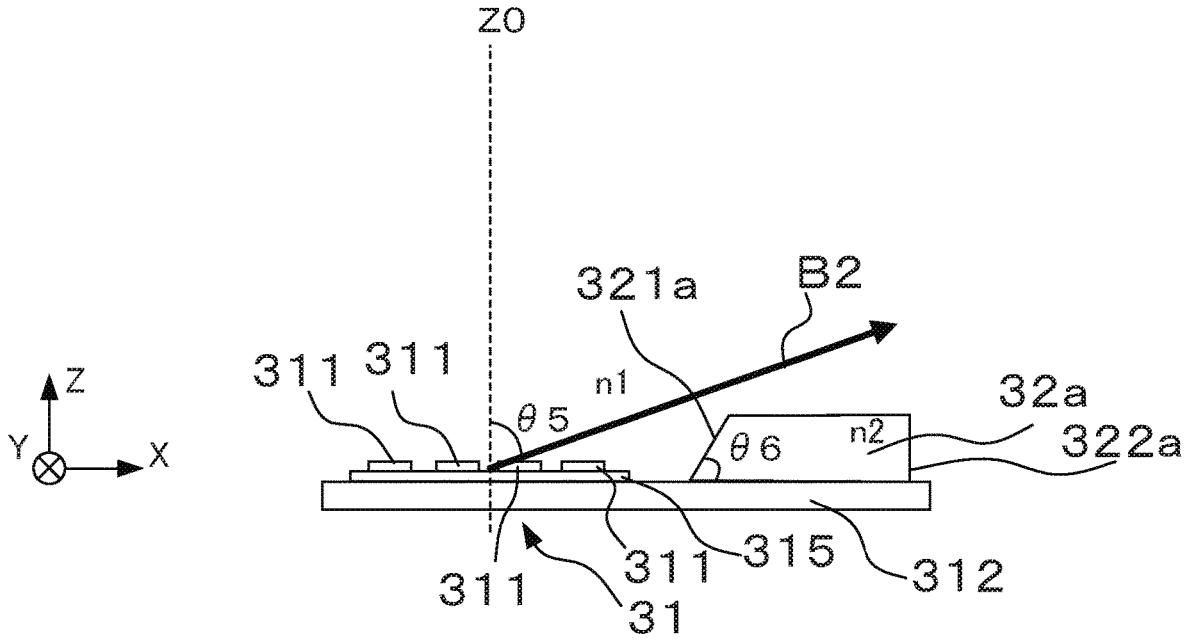
FIG. 5B illustrates a third example of the shape of the side wall.

FIG. 5A illustrates a second example of the shape of side wall 32*a*. FIG. 5B illustrates a third example of the shape of side wall 32*a*. Note that, in FIGS. 5A and 5B, the same configurations as those of FIGS. 3A and 3B are denoted by the same reference signs, and descriptions thereof are omitted. Further, in FIGS. 5A and 5B, some configurations illustrated in FIGS. 3A and 3B are omitted for convenience of illustration.

As with FIG. 4, FIGS. 5A and 5B are examples in which array antenna 31 radiates radio waves in the space having refractive index n1. Further, side walls 32*a* in FIGS. 5A and 5B are filled with the dielectric having refractive index n2. Note that, FIGS. 5A and 5B illustrate examples in which side walls 32*a* of both have different heights.

θ5 in FIGS. 5A and 5B is the maximum tilt angle of array antenna 31. Note that, the maximum tilt angle represents the maximum value of a tilt angle in which array antenna 31 is capable of controlling the directivity. For example, the maximum tilt angle is determined by antenna element 311 included in array antenna 31.

θ6 in FIGS. 5A and 5B is an angle of inclination of first side surface 321*a* determined based on maximal tilt angle θ5, refractive index n1, refractive index n2, and equation 2.

Arrow B1 in FIG. 5A indicates a traveling direction of radio waves in a case where array antenna 31 radiates the radio waves having the maximum gain in the direction of maximum tilt angle θ5.

In the case of FIG. 5A, side wall 32*a* has a height that allows the radio waves having the maximum gain in the direction of maximum tilt angle θ5 to be made incident. In this case, as indicated by arrow B1, the radio waves incident on first side surface 321*a* are refracted on first side surface 321*a* in the direction along the X axis, and are emitted from second side surface 322*a*.

Arrow B2 in FIG. 5B indicates a traveling direction of the radio waves in a case where array antenna 31 radiates the radio waves having the maximum gain in the direction of maximum tilt angle θ5.

In the case of FIG. 5B, side wall 32*a* has a height lower than the height that allows the radio waves having the maximum gain in the direction of maximum tilt angle θ5 to be made incident. In this case, since the radio waves are not made incident on first side surface 321*a* as indicated by arrow B2, antenna apparatus 30 is incapable of radiating radio waves in the direction of the X axis.

As illustrated in FIGS. 5A and 5B, first side surface 321*a* of side wall 32*a* is preferably provided at a position determined based on maximum tilt angle θ5.

For example, in a case where maximum tilt angle θ5 of array antenna 31 is 50 degrees and a beam half-value angle is approximately 20 degrees, first side surface 321*a* of side wall 32*a* is preferably provided in a range from 0 degrees to 60 degrees, with line Z0 as a reference of an angle of 0 degrees, on the X-Z plane. Similarly, for side wall 32*b* as well, first side surface 321*b* of side wall 32*b* is preferably provided in a range from −60 degrees to 0 degrees.

Note that, the case where maximum tilt angle θ5 is 50 degrees and the beam half value angle is approximately 20 degrees indicates that a range of ±10 degrees with respect to the maximum tilt angle of 50 degrees, that is, a range from 40 degrees to 60 degrees has good characteristic. Accordingly, first side surface 321*a* of side wall 32*a* is preferably provided in a range of up to 60 degrees.

Next, an example of the characteristic of antenna apparatus 30 will be described.

FIG. 6 illustrates a table of exemplary excitation phases in which antenna element 311 is excited. FIG. 6 illustrates magnitudes of excitation phases in which antenna elements #1 to #4 are excited for four cases of Cases 1 to 4.

For example, Case 1 is a case where antenna elements #1 to #4 are excited in the same phase. Case 2 is a case where the excitation is performed by providing a phase difference of 60 degrees between adjacent antenna elements. Case 3 is a case where the excitation is performed by providing a phase difference of 150 degrees between adjacent antenna elements. Case 4 is a case where the excitation is performed by providing a phase difference of −150 degrees between adjacent antenna elements.

Figure 7:
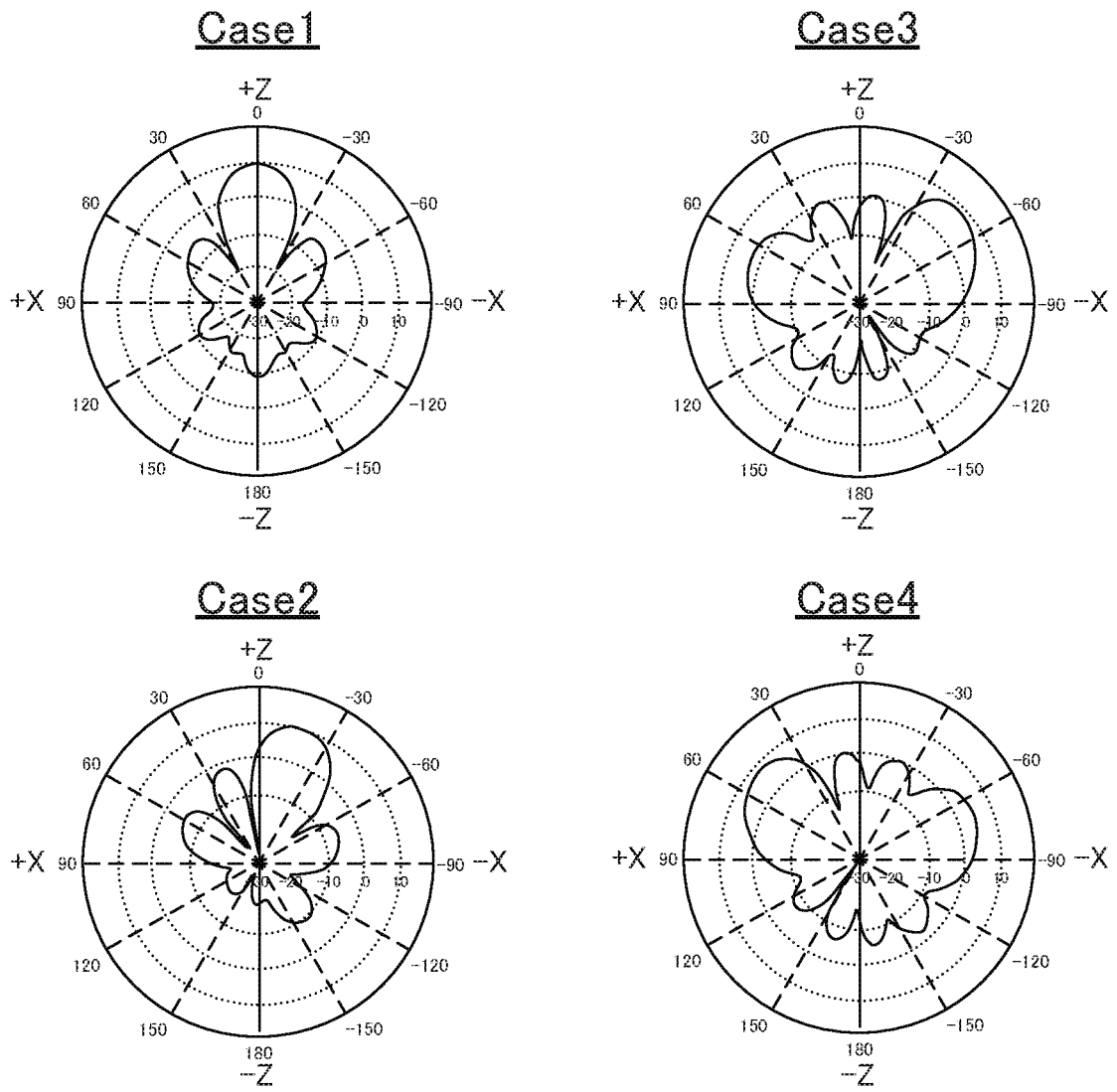
FIG. 7 illustrates exemplary directional patterns of an array antenna based on the excitation phases illustrated in FIG. 6.

FIG. 7 illustrates exemplary directional patterns of array antenna 31 based on the excitation phases illustrated in FIG. 6. The directional patterns of array antenna 31 illustrated in FIG. 7 are directional patterns on the X-Z plane in a state in which side wall 32 is excluded from antenna apparatus 30.

FIG. 7 indicates directional patterns for the respective four cases illustrated in FIG. 6. Note that, the angles in the directional patterns illustrated in FIG. 7 are angles formed with line Z0 illustrated in FIG. 3A.

For example, in the directional pattern of Case 1, the direction having the maximum gain is the direction of 0 degrees that is the positive direction of the Z axis. Further, in the directional pattern of Case 2, the direction having the maximum gain is the direction of approximately −30 degrees. Further, in the directional pattern of Case 3, the direction having the maximum gain is the direction of approximately −50 degrees. Further, in the directional pattern of Case 4, the direction having the maximum gain is the direction of approximately 50 degrees.

Figure 8:
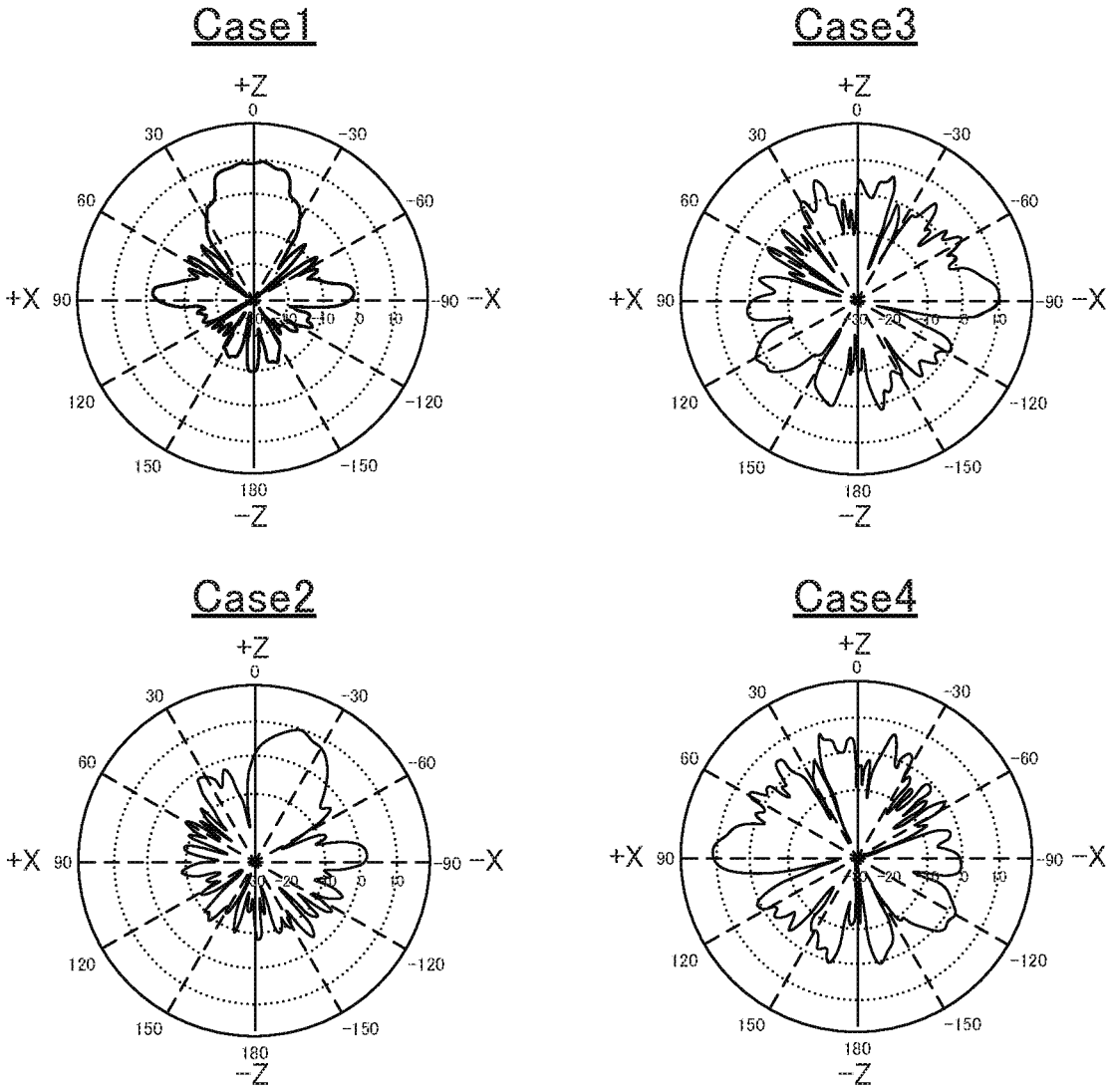
FIG. 8 illustrates exemplary directional patterns of the antenna apparatus based on the excitation phases illustrated in FIG. 6.

FIG. 8 illustrates exemplary directional patterns of antenna apparatus 30 based on the excitation phases illustrated in FIG. 6. The directional patterns of antenna apparatus 30 illustrated in FIG. 8 are directional patterns on the X-Z plane.

Note that, the directional patterns illustrated in FIG. 8 are examples of directional patterns in a case where first side surface 321*a* of side wall 32*a* has angle of inclination θ2 of 60 degrees and the dielectric filled in side wall 32*a* (or the dielectric configuring side wall 32*a*) has a refractive index of 1.82. Note that, side wall 32*b* and side wall 32*a* are provided plane symmetrically with respect to the Y-Z plane along line Z0.

For example, in the directional pattern of Case 1, the direction having the maximum gain is the direction of 0 degrees that is the positive direction of the Z axis as with the case of FIG. 7. Further, in the directional pattern of Case 2, the direction having the maximum gain is the direction of approximately −30 degrees as with the case of FIG. 7.

In the directional pattern of Case 3, the direction having the maximum gain is the direction of approximately −90 degrees, that is, the negative direction of the X axis. Further, in the directional pattern of Case 4, the direction having the maximum gain is the direction of approximately 90 degrees, that is, the positive direction of the X axis.

As indicated by a comparison between Case 3 of FIG. 7 and Case 3 of FIG. 8, radio waves that are radiated by array antenna 31 and that have the maximum gain in the direction of −50 degrees are refracted at side wall 32*b* in the negative direction of the X axis and are radiated from side wall 32.

As indicated by a comparison between Case 4 of FIG. 7 and Case 4 of FIG. 8, radio waves that are radiated by array antenna 31 and that have the maximum gain in the direction of 50 degrees are refracted at side wall 32*a* in the positive direction of the X axis and are radiated from side wall 32.

As illustrated in FIG. 8, antenna apparatus 30 is capable of forming beams of radiation patterns in which the vertical direction, the obliquely upward direction, and the horizontal direction with respect to the arrangement direction of antenna element 311 indicate the maximum gain.

As described above, antenna apparatus 30 according to the present embodiment includes: array antenna 31 that includes at least one antenna element 311 disposed on the first surface (the surface in the positive direction of the Z axis) of insulation layer 315 of the substrate and that forms beams in respective directions forming a plurality of angles with respect to the first surface of the substrate, and side wall 32 that is provided in at least a part of a periphery of at least one antenna element 311 and that refracts, in a direction along the plane of the substrate, the first beam in a direction forming tilt angle θ1 (θx=90°−θ1 with respect to the plane of the substrate) among beams formed by array antenna 31.

Since the above configuration makes it possible to form beams in the horizontal direction by using refraction on a side surface of side wall 32, control of the directivity in various directions can be realized with a simple configuration.

For example, antenna apparatus 30 is capable of controlling the directivity in a direction vertical to the plane on which antenna element 311 is disposed, in an oblique direction (for example, an angle of 30 degrees to 45 degrees with respect to the vertical direction), and in a direction horizontal to the plane.

For example, in a case where antenna apparatus 30 is mounted on a vehicle such that the X-Y plane of antenna apparatus 30 is along a road surface, antenna apparatus 30 is capable of controlling the directivity in the vertical direction and in the oblique direction in the situation of road-to-vehicle communication (see FIG. 1), and is capable of controlling the directivity in the horizontal direction in the situation of vehicle-to-vehicle communication (see FIG. 2).

Further, array antenna 31 included by antenna apparatus 30 includes reflector 312 on a rear side of antenna element 311. This configuration enables antenna apparatus 30 to restrain influence of electromagnetic noise.

In a case where antenna apparatus 30 is mounted on a dashboard of a vehicle, electromagnetic noise from an engine control unit (ECU) may reach antenna apparatus 30 because the ECU is mounted close to the ground with respect to the dashboard. Since antenna apparatus 30 includes reflector 312 on the rear side of antenna element 311, it is possible to restrain electromagnetic noise from reaching antenna element 311.

Further, for example, in a case where antenna apparatus 30 is mounted on a roof portion of a vehicle, a metal plate of the roof portion is located in a periphery of antenna element 311. In such a case, by mounting antenna apparatus 30 such that reflector 312 is located between antenna element 311 and the metal plate, radio waves radiated from antenna element 311 to the rear side are reflected by reflector 312, and therefore do not reach the metal plate. Accordingly, it is possible to prevent the radio waves radiated from antenna element 311 to the rear side from reaching the metal plate to cause deviation in the directivity of antenna apparatus 30.

Note that, the operating frequency band of antenna apparatus 30 in the present embodiment is, for example, a frequency band having a strong rectilinearity of radio waves, and is illustratively a quasi-millimeter wave band, a millimeter wave band or a terahertz band. In a case where antenna apparatus 30 operates in a frequency band having a strong rectilinearity of radio waves, radio waves can be efficiently radiated since a decrease in radiation efficiency due to leakage of radio waves radiated from array antenna 31 at an end portion of side wall 32 is small.

Next, variations of the shapes of second side surface 322*a* and second side surface 322*b* of side wall 32 will be described.

(Variation 1)

Figure 9:
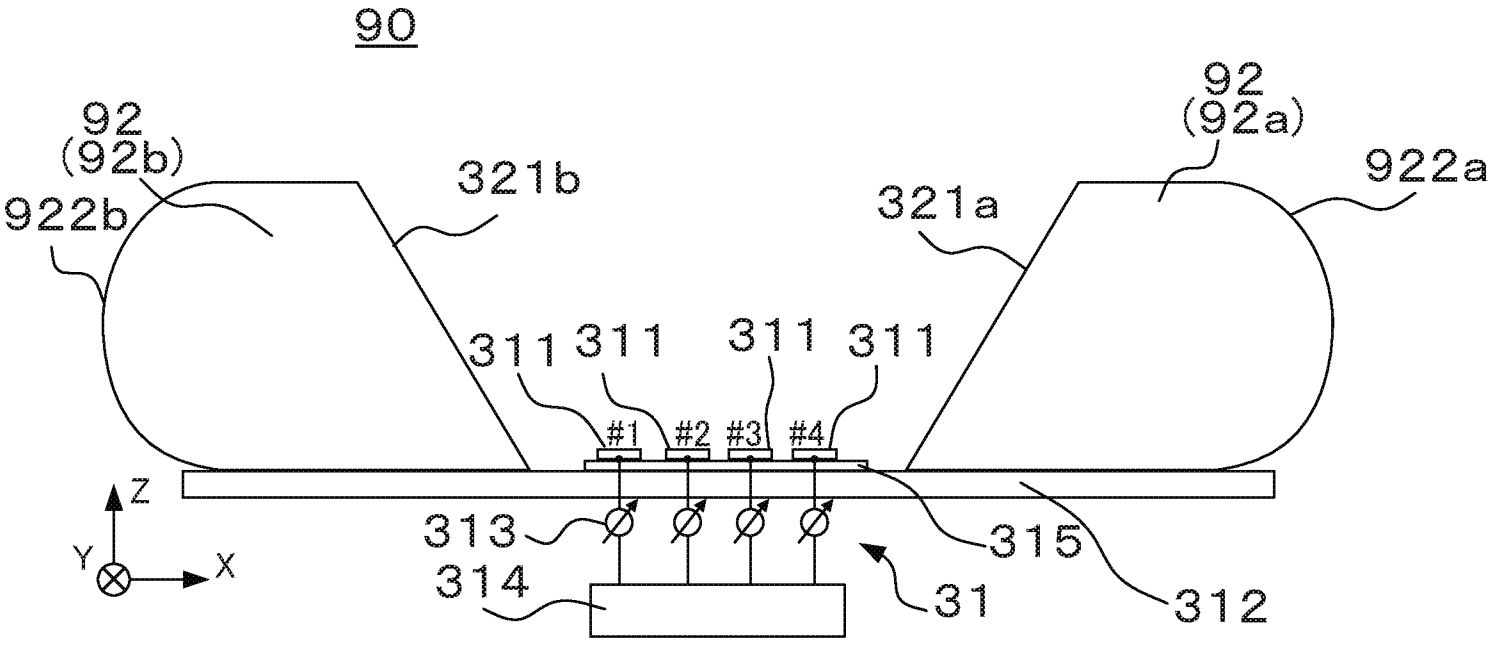
FIG. 9 is a side view of an example of an antenna apparatus according to Variation 1 of the embodiment of the present disclosure.

FIG. 9 is a side view of an example of antenna apparatus 90 according to Variation 1 of the embodiment of the present disclosure. Note that, in FIG. 9, the same configurations as those of FIG. 3A are denoted by the same reference signs, and descriptions thereof are omitted.

Antenna apparatus 90 includes array antenna 31 and side wall 92.

Side wall 92 refracts a first beam in a direction forming first angle θx formed by array antenna 31, in a direction along a plane (an X-Y plane) on which antenna element 311 is provided.

Side wall 92 includes side wall 92*a* and side wall 92*b*. Side wall 92*a* has a configuration in which second side surface 322*a* of side wall 32 of antenna apparatus 30 is replaced with second side surface 922*a*. Further, side wall 92*b* has a configuration in which second side surface 322*b* of side wall 32*b* of antenna apparatus 30 is replaced with second side surface 922*b*.

Each of second side surface 922*a* and second side surface 922*b* has a lens shape in which a curved surface is formed. Since radio waves radiated from array antenna 31 can be intensified as a result of second side surface 922*a* and second side surface 922*b* having a lens shape, the radio waves can be efficiently radiated from second side surface 922*a* and second side surface 922*b*.

Note that, in antenna apparatus 30 and antenna apparatus 90 described above, an example in which antenna elements 311 are arranged one-dimensionally in the direction of the X axis has been indicated. The present disclosure is not limited thereto. Hereinafter, an example in which the antenna elements are arranged two-dimensionally will be indicated.

(Variation 2)

Figure 10:
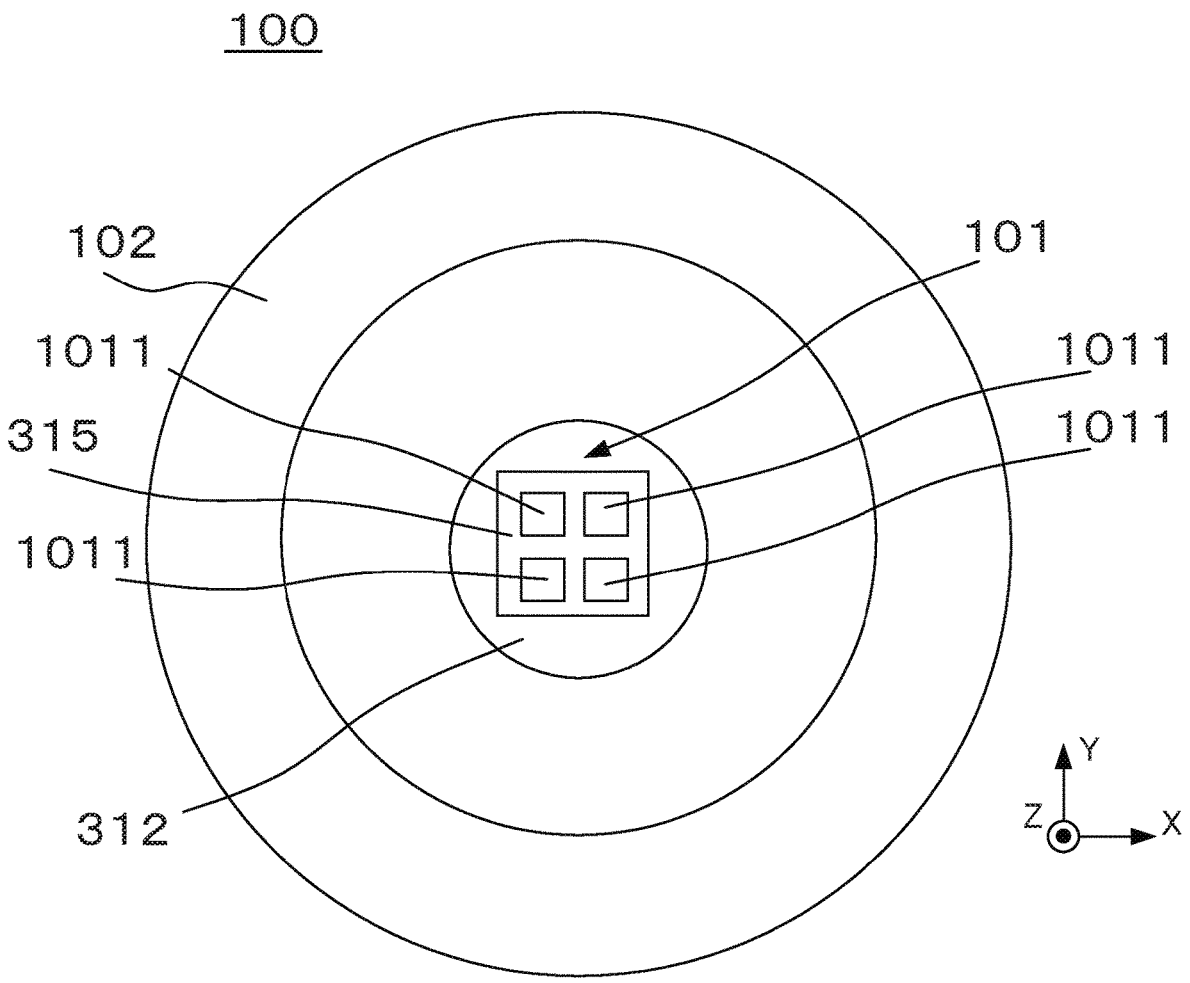
FIG. 10 is a plan view of an example of an antenna apparatus according to Variation 2 of the embodiment of the present disclosure.

FIG. 10 is a plan view of an example of antenna apparatus 100 according to Variation 2 of the embodiment of the present disclosure. Antenna apparatus 100 illustrated in FIG. 10 includes array antenna 101 and side wall 102.

Array antenna 101 has a configuration in which antenna element 311 of array antenna 31 is replaced with antenna element 1011.

Array antenna 101 includes antenna element 1011 disposed on a plane of insulation layer 315 of a substrate, and forms beams in respective directions forming a plurality of angles with respect to the plane of the substrate. The directions of the beams formed by array antenna 101 includes at least first angle θx.

For example, as illustrated in FIG. 10, four antenna elements 1011 are arranged in two directions of the direction of the X axis and the direction of the Y axis.

By the arrangement of antenna elements 1011 two-dimensionally, controller 314 (see FIG. 3A) controls the directivity of an X-Z plane and the directivity of a Y-Z plane of array antenna 101.

Side wall 102 has an annular shape surrounding a periphery of array antenna 101 in plan view. Side wall 102 has a configuration that causes a first beam in a direction forming first angle θx formed by array antenna 101 to be refracted in the direction along the plane (X-Y plane) on which antenna element 1011 is provided.

Since the above configuration makes it possible to form beams in the horizontal direction by using refraction on a side surface of side wall 102, the control of the directivity in various directions can be realized with a simple configuration. Furthermore, since array antenna 101 is capable of controlling the directivity of the X-Z plane and the directivity of the Y-Z plane, it is possible to form beams in the horizontal direction along the direction of the X axis as well as, for example, in the horizontal direction along the direction of the Y axis.

(Variation 3)

Figure 11:
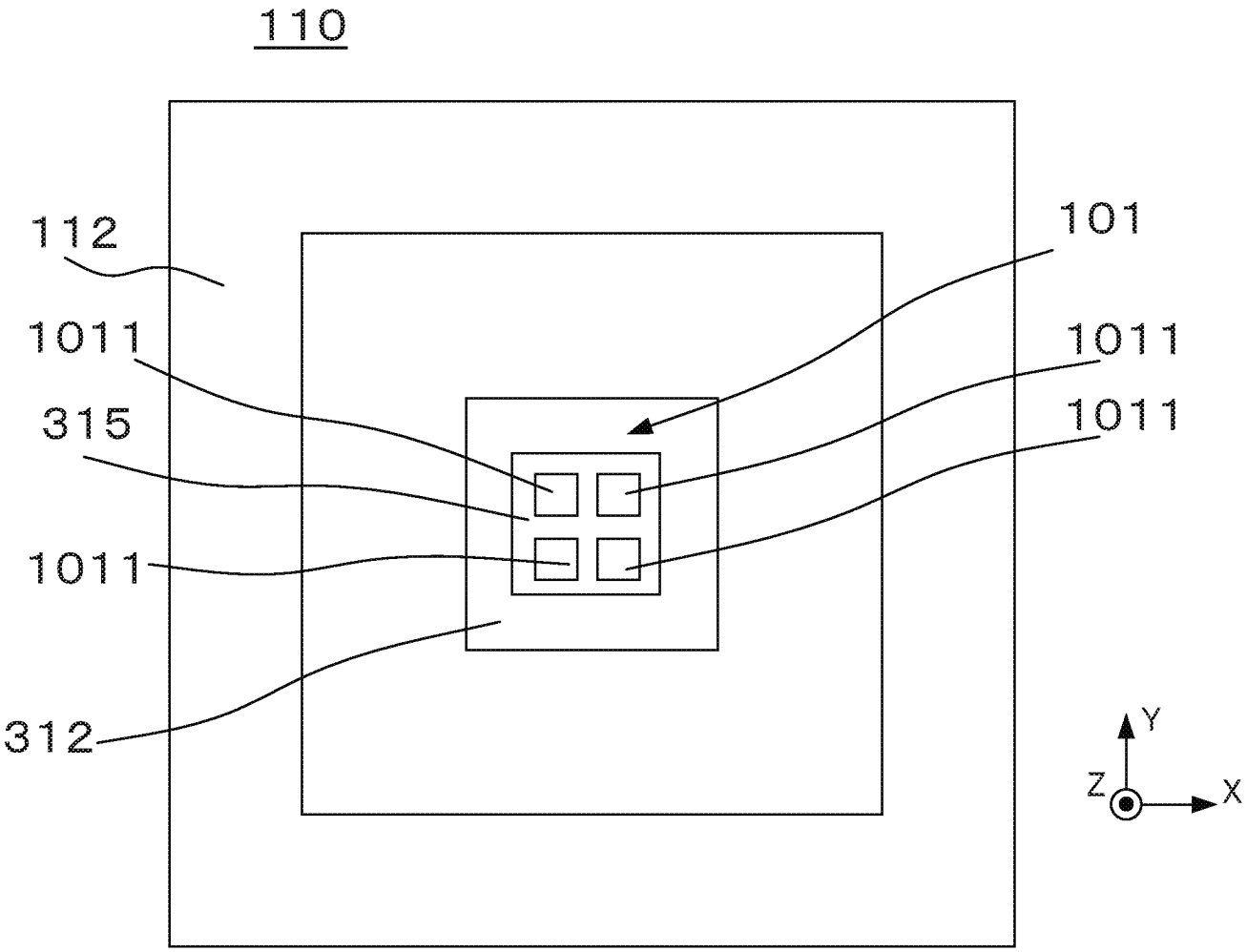
FIG. 11 is a plan view of an example of an antenna apparatus according to Variation 3 of the embodiment of the present disclosure.

FIG. 11 is a plan view of an example of antenna apparatus 110 according to Variation 3 of the embodiment of the present disclosure. Note that, in FIG. 11, the same configurations as those of FIG. 10 are denoted by the same reference signs, and descriptions thereof are omitted.

Antenna apparatus 110 illustrated in FIG. 11 includes array antenna 101 and side wall 112.

Side wall 112 has a rectangular shape surrounding a periphery of array antenna 101 in plan view. Side wall 112 has a configuration that causes a first beam in a direction forming first angle θ1 formed by array antenna 101 to be refracted in a direction along a plane (an X-Y plane) on which antenna element 1011 is provided.

Since the above configuration makes it possible to form beams in the horizontal direction by using refraction on a side surface of side wall 112, the control of the directivity in various directions can be realized with a simple configuration. Furthermore, since array antenna 101 is capable of controlling the directivity of the X-Z plane and the directivity of the Y-Z plane, it is possible to form beams in the horizontal direction along the direction of the X axis as well as, for example, in the horizontal direction along the direction of the Y axis.

Note that, FIG. 10 has indicated an example in which side wall 102 has an annular shape surrounding the periphery of array antenna 101 in plan view, and FIG. 11 has indicated an example in which side wall 112 has a rectangular shape surrounding the periphery of array antenna 101 in plan view. The present disclosure is not limited thereto. For example, the side wall may have a polygonal shape other than a rectangular shape. Further, FIGS. 10 and 11 have indicated examples in which the side walls have a shape with symmetry in the periphery of the array antenna. The present disclosure is not limited thereto. The shapes of the side walls may be asymmetric.

Note that, in the antenna apparatuses described above, examples of forming beams in the horizontal direction by using refraction on a side surface of a side wall have been indicated. The present disclosure is not limited to the horizontal direction. For example, radio waves may be radiated in the negative direction rather than in the horizontal direction. For example, since a direction of refraction on a side surface of a side wall can be set based on a radiation direction of radio waves radiated by an array antenna, an angle of inclination of the side surface of the side wall, and refractive indices of two layers (for example, an air layer and a dielectric layer) sandwiching the side surface, it is possible to realize radiation of radio waves in various directions that are not limited to the horizontal direction, by setting the angle of inclination of the side surface so as to radiate the radio waves in a desired direction.

Note that, the notation "array antenna" used in the description of each embodiment described above may be replaced with other notations such as "array antenna section", array antenna circuit, array antenna device, array antenna unit, and array antenna module.

Further, the notation " . . . section" or "-er, -or, and -ar" used in the description of the each embodiment described above may be replaced with other notations such as " . . . circuitry", " . . . device", and " . . . module".

The present disclosure can be realized by software, hardware, or software in cooperation with hardware.

Each functional block used in the description of the each embodiment described above can be partly or entirely realized by an LSI such as an integrated circuit, and each process described in the embodiment may be controlled partly or entirely by the same LSI or a combination of LSIs. The LSI may be individually formed as chips, or one chip may be formed so as to include a part or all of the functional blocks. The LSI may include a data input and output coupled thereto. The LSI here may be referred to as an IC, a system LSI, a super LSI, or an ultra LSI depending on a difference in the degree of integration.

However, the technique of implementing an integrated circuit is not limited to the LSI and may be realized by using a dedicated circuit, a general-purpose processor, or a special-purpose processor. In addition, a FPGA (Field Programmable Gate Array) that can be programmed after the manufacture of the LSI or a reconfigurable processor in which the connections and the settings of circuit cells disposed inside the LSI can be reconfigured may be used. The present disclosure can be realized as digital processing or analogue processing.

If future integrated circuit technology replaces LSIs as a result of the advancement of semiconductor technology or other derivative technology, the functional blocks could be integrated using the future integrated circuit technology. Biotechnology can also be applied.

The present disclosure can be realized by any kind of apparatus, device or system having a function of communication, which is referred to as a communication apparatus. Some non-limiting examples of such a communication apparatus include a phone (e.g. cellular (cell) phone, smart phone), a tablet, a personal computer (PC) (e.g. laptop, desktop, netbook), a camera (e.g. digital still/video camera), a digital player (digital audio/video player), a wearable device (e.g. wearable camera, smart watch, tracking device), a game console, a digital book reader, a telehealth/telemedicine (remote health and medicine) device, and a vehicle providing communication functionality (e.g. automotive, airplane, ship), and various combinations thereof.

The communication apparatus is not limited to be portable or movable, and may also include any kind of apparatus, device or system being non-portable or stationary, such as a smart home device (e.g. an appliance, lighting, smart meter, control panel), a vending machine, and any other "things" in a network of an "Internet of Things (IoT)".

The communication may include exchanging data through, for example, a cellular system, a wireless LAN system, a satellite system, etc., and various combinations thereof.

The communication apparatus may comprise a device such as a controller or a sensor which is coupled to a communication device performing a function of communication described in the present disclosure. For example, the communication apparatus may comprise a controller or a sensor that generates control signals or data signals which are used by a communication device performing a communication function of the communication apparatus.

The communication apparatus also may include an infrastructure facility, such as a base station, an access point, and any other apparatus, device or system that communicates with or controls apparatuses such as those in the above non-limiting examples.

Various embodiments have been described above with reference to the drawings. However, it goes without saying that the present disclosure is not limited to these embodiments. It is obvious that one of ordinary skill in the art can conceive various modified examples and correction examples within the scope recited in the claims. It should be naturally understood that these modified examples and correction examples belong to the technical scope of the present disclosure. Furthermore, each component of the above embodiment may be optionally combined without departing from the gist of the disclosure.

An antenna apparatus in an embodiment of the present disclosure includes: an array antenna that includes at least one antenna element disposed on a first surface of a substrate and that forms beams in respective directions forming a plurality of angles including a first angle with respect to the first surface of the substrate; and a side wall that is provided in at least a part of a periphery of the at least one antenna element and that refracts a first beam in a direction along the substrate, the first beam being in a direction forming the first angle.

In the antenna apparatus of the embodiment of the present disclosure, the array antenna includes a phase shifter that controls an excitation phase of the at least one antenna element, and a control circuit that controls a phase of the phase shifter.

In the antenna apparatus of the embodiment of the present disclosure, the array antenna includes a reflector on a surface opposite to the first surface of the substrate.

In the antenna apparatus of the embodiment of the present disclosure, an insulation layer is provided between the at least one antenna element and the reflector.

In the antenna apparatus of the embodiment of the present disclosure, the side wall includes a first side surface on which the first beam is made incident, and a second side surface from which the first beam is emitted after being refracted thereon, and an angle of inclination of the first side surface with respect to the first surface of the substrate and an angle of inclination of the second side surface with respect to the first surface of the substrate are set based on the first angle.

In the antenna apparatus of the embodiment of the present disclosure, the angle of inclination of the first side surface with respect to the first surface of the substrate is 65° or less.

In the antenna apparatus of the embodiment of the present disclosure, the first side surface has a tapered shape such that the first side surface is away from an axis vertical to the first surface of the substrate as a distance of the first side surface from the substrate increases.

In the antenna apparatus of the embodiment of the present disclosure, the second side surface is vertical to the first surface of the substrate.

In the antenna apparatus of the embodiment of the present disclosure, the second side surface has a lens shape.

In the antenna apparatus of the embodiment of the present disclosure, the at least one antenna element is a plurality of antenna elements, the plurality of antenna elements are disposed on the substrate in a one-dimensional arrangement direction, and the side wall is provided on an extension line of the arrangement direction.

In the antenna apparatus of the embodiment of the present disclosure, the at least one antenna element is a plurality of antenna elements, the plurality of antenna elements are disposed on the substrate in a two-dimensional direction, and the side wall is provided at a position surrounding the plurality of antenna elements.

In the antenna apparatus of the embodiment of the present disclosure, the at least one antenna element has an operating frequency included in at least one of a quasi-millimeter-wave band, a millimeter-wave band, and a terahertz band.

In the antenna apparatus of the embodiment of the present disclosure, the side wall is filled with a dielectric.

In the antenna apparatus of the embodiment of the present disclosure, the side wall has at least a height that allows a beam in a direction forming an angle of 30° with respect to the first surface of the substrate to be made incident.

The disclosure of Japanese Patent Application No. 2018-076907, filed on Apr. 12, 2018, including the specification, drawings and abstract, is incorporated herein by reference in its entirety.

INDUSTRIAL APPLICABILITY

The embodiment of the present disclosure is suitable for use in a radio communication apparatus.

REFERENCE SIGNS LIST

11, 21, 22 Vehicle
12 Roadside machine
30, 90, 100, 110 Antenna apparatus
31, 101 Array antenna
32, 32*a*, 32*b*, 92, 92*a*, 92*b*, 102, 112 Side wall
311, 1011 Antenna element
312 Reflector
313 Phase shifter
314 Controller
315 Insulation layer
321*a*, 321*b* First side surface
322*a*, 322*b*, 922*a*, 922*b* Second side surface

The invention claimed is:

1. An antenna apparatus mounted on a first vehicle, comprising:

an array antenna that includes at least one antenna element disposed on a first surface of a substrate and that forms beams in respective directions, the directions respectively forming a plurality of angles including a first angle with respect to the first surface of the substrate and the first surface of the substrate being provided along a traveling surface of the first vehicle; and a side wall that is provided in at least a part of a periphery of the at least one antenna element and that refracts a first beam in a direction along the substrate, the first beam being in a direction forming the first angle, wherein the array antenna forms the first beam for communicating with a first radio communication apparatus mounted on a second vehicle positioned in the direction along the substrate, and the array antenna forms a second beam in a direction forming a second angle different from the first angle for communicating with a second radio communication apparatus positioned in different direction than the direction of the first radio communication apparatus along the substrate, a position of the second radio communication apparatus being higher than a position of the antenna apparatus.

2. The antenna apparatus according to claim 1, wherein:

the array antenna includes a phase shifter that controls an excitation phase of the at least one antenna element, and a control circuit that controls a phase of the phase shifter.

3. The antenna apparatus according to claim 1, wherein:

the array antenna includes a reflector on a surface opposite to the first surface of the substrate.

4. The antenna apparatus according to claim 3, wherein:

an insulation layer is provided between the at least one antenna element and the reflector.

5. The antenna apparatus according to claim 1, wherein:

the side wall includes a first side surface on which the first beam is made incident, and a second side surface from which the first beam is emitted after being refracted thereon, and an angle of inclination of the first side surface with respect to the first surface of the substrate and an angle of inclination of the second side surface with respect to the first surface of the substrate are set based on the first angle.

6. The antenna apparatus according to claim 5, wherein:

the angle of inclination of the first side surface with respect to the first surface of the substrate is 65° or less.

7. The antenna apparatus according to claim 5, wherein:

the first side surface has a tapered shape such that the first side surface is away from an axis vertical to the first surface of the substrate as a distance of the first side surface from the substrate increases.

8. The antenna apparatus according to claim 5, wherein:

the second side surface is vertical to the first surface of the substrate.

9. The antenna apparatus according to claim 5, wherein:

the second side surface has a lens shape.

10. The antenna apparatus according to claim 1, wherein:

the at least one antenna element is a plurality of antenna elements, the plurality of antenna elements are disposed on the substrate in a one-dimensional arrangement direction, and the side wall is provided on an extension line of the arrangement direction.

11. The antenna apparatus according to claim 1, wherein:

the at least one antenna element is a plurality of antenna elements, the plurality of antenna elements are disposed on the substrate in a two-dimensional direction, and the side wall is provided at a position surrounding the plurality of antenna elements.

12. The antenna apparatus according to claim 1, wherein:

the at least one antenna element has an operating frequency included in at least one band selected from a quasi-millimeter-wave band, a millimeter-wave band, and a terahertz band.

13. The antenna apparatus according to claim 1, wherein:

the side wall is filled with a dielectric.

14. The antenna apparatus according to claim 1, wherein:

the side wall has at least a height that allows a beam in a direction forming an angle of 30° with respect to the first surface of the substrate to be made incident.

15. The antenna apparatus according to claim 1, wherein:

a third vehicle is positioned in the direction along the substrate, one of the second vehicle and the third vehicle is positioned in front of the first vehicle, the other one of the second vehicle and the third vehicle is positioned rearward of the first vehicle, and the array antenna forms a third beam in a direction forming a third angle different from the first angle and the second angle for communicating with a third radio communication apparatus mounted on the third vehicle.

* * * * *